US006003968A

United States Patent [19]

Kozawa

[11] Patent Number: 6,003,968

[45] Date of Patent: Dec. 21, 1999

[54] INK JET HEAD

[75] Inventor: Hirokazu Kozawa, Aichi-ken, Japan

[73] Assignee: Brother Kogyo Kabushiki Kaisha, Nagoya, Japan

[21] Appl. No.: 08/745,836

[22] Filed: Nov. 8, 1996

[30] Foreign Application Priority Data

Nov. 20, 1995 [JP] Japan ..... 7-326548

[51] Int. Cl.[6] ..... B41J 2/135; B41J 2/14

[52] U.S. Cl. ..... 347/20; 347/70; 347/71

[58] Field of Search ..... 347/70, 71, 20

[56] References Cited

U.S. PATENT DOCUMENTS 4,935,086 6/1990 Baker et al. ..... 156/246
5,376,856 12/1994 Takeuchi et al. ..... 310/328
5,439,728 8/1995 Morozumi et al. ..... 428/136
5,473,216 12/1995 Brosig et al. ..... 310/346

FOREIGN PATENT DOCUMENTS 6-79871 3/1994 Japan .

*Primary Examiner*—John Barlow
*Assistant Examiner*—Christina Annick
*Attorney, Agent, or Firm*—Oliff & Berridge, PLC

[57] ABSTRACT

An ink jet head including a diaphragm, cavity plate, piezoelectric element, a nozzle plate and a base plate. The adhesive layer for bonding the diaphragm to the cavity plate is formed by an adhesive agent which develops glass transition at a head temperature. The adhesive layers for bonding the piezoelectric element to the diaphragm, the cavity plate to the nozzle plate, and the piezoelectric element to the base plate are each formed by an adhesive agent which does not develop glass transition at the head temperature.

17 Claims, 5 Drawing Sheets

| | COMPONENTS WITH LARGE DIFFERENCE IN THERMAL EXPANSION COEFFICIENTS PES AND ALUMINA | | COMPONENTS WITH SMALL DIFFERENCE IN THERMAL EXPANSION COEFFICIENTS PZT AND ALUMINA | |
|---|---|---|---|---|
| | KEPT AT 125°C | THERMAL CYCLE REPEATED | KEPT AT 125°C | THERMAL CYCLE REPEATED |
| HIGH Tg TYPE ADHESIVE (GLASS TRANSITION TEMPERATURE : HIGHER THAN 125°C) | ○ | × | ◎ | ◎ |
| MEDIUM Tg TYPE ADHESIVE (GLASS TRANSITION TEMPERATURE : 85°C TO 125°C) | △ | × | △ | ○ |
| LOW Tg TYPE ADHESIVE (GLASS TRANSITION TEMPERATURE : LOWER THAN 85°C) | △ | ○ | △ | ○ |

Fig.5

| | COMPONENTS WITH LARGE DIFFERENCE IN THERMAL EXPANSION COEFFICIENTS PES AND ALUMINA | | COMPONENTS WITH SMALL DIFFERENCE IN THERMAL EXPANSION COEFFICIENTS PZT AND ALUMINA | |
|---|---|---|---|---|
| | KEPT AT 125℃ | THERMAL CYCLE REPEATED | KEPT AT 125℃ | THERMAL CYCLE REPEATED |
| HIGH Tg TYPE ADHESIVE (GLASS TRANSITION TEMPERATURE : HIGHER THAN 125℃) | ○ | × | ◎ | ◎ |
| MEDIUM Tg TYPE ADHESIVE (GLASS TRANSITION TEMPERATURE : 85℃ TO 125℃) | △ | × | △ | ○ |
| LOW Tg TYPE ADHESIVE (GLASS TRANSITION TEMPERATURE : LOWER THAN 85℃) | △ | ○ | △ | ○ |

INK JET HEAD

BACKGROUND OF THE INVENTION

1. Field of the Invention

The present invention relates to a hot melt type ink jet head for melting solid ink and jetting the melted ink onto print paper for printing thereon. More particularly, the invention relates to an ink jet head capable of preventing the worsening of ink jetting performance attributable to the difference in thermal expansion coefficient of the components for the ink jet head.

2. Description of Related Art

One of the known types of ink jet head (abbreviated where appropriate to "the head" hereinafter) is the so-called thermal type head comprising ink chambers each having a nozzle and incorporating a heating element. In operation, suitably selected heating elements are energized and heated to produce air bubbles in the ink chambers. The pressure exerted by the generated bubbles causes ink to jet out of the nozzles.

Another known type of head is the so-called piezoelectric type head comprising ink chambers on top of which are furnished piezoelectric elements constituted by piezoelectric films made of piezoelectric material and by electrode films for applying voltages to the piezoelectric films. In operation, voltages are fed to suitably selected electrode films displacing the applicable piezoelectric elements through the piezoelectric effect generated therein. The displaced piezoelectric elements in turn change the volumes of the corresponding ink chambers, causing ink to jet out of the chambers through their nozzles. Piezoelectric head printers typically have a hot melt type ink jet head housing solid ink in an ink tank. The solid ink is melted by heat to be jetted out as liquid ink through the nozzles.

A typical hot melt type head that is driven piezoelectrically will now be described with reference to some of the accompanying drawings. Because the conventional head and the head of the invention are basically identical in structure, the drawings used to describe the inventive head are usefully referenced to describe the prior art hereunder.

FIGS. 2A and 2B are partially sectional views of the head according to the invention. FIG. 3 is a partially sectional view in effect when the head of FIGS. 2A and 2B is seen laterally.

A diaphragm (vibrating plate) 34 is made of an aramid film, such as of a highly aromatic polyamide fiber film. On top of the diaphragm 34 are piezoelectric elements 36 composed of piezoelectric material and secured to the diaphragm by an adhesive layer 37. Below the diaphragm 34 is a cavity plate 31 made of PES (polyether sulfone) and bonded by an adhesive layer 35 to the diaphragm.

A plurality of ink chambers 30 are formed within the cavity plate 31. Under the cavity plate 31 is a nozzle plate 32 made of nickel and fixed by an adhesive layer 48 to the cavity plate. The nozzle plate 32 has a plurality of nozzles 33 through which ink is jetted out. On top of the piezoelectric elements 36 is a base plate 50 which, made of alumina, supports the piezoelectric elements 36 and is secured by an adhesive layer 49 to the piezoelectric elements. Furthermore, as shown in FIG. 3, the piezoelectric elements 36 are topped with a heater 42 that keeps the ink melted in the ink chambers 30. When a suitably selected piezoelectric element 36 is energized, it is displaced through the piezoelectric effect generated therein so as to bend the diaphragm 34 into a downward convex shape, as described in FIG. 2B.

The convexly deformed diaphragm changes the volume of the corresponding ink chamber 30 and thereby gives pressure to the ink therein. Under pressure, the ink is jetted out of the chamber through the nozzle 33 in the arrowed direction.

Meanwhile, the adhesive agent that forms the adhesive layers 35, 37, 48 and 49 typically has two properties. One is that the adhesive agent develops glass transition at a certain temperature (e.g., 124° C.). The other one is that the adhesive agent deteriorates under the influence of heat.

Suppose that the head is heated by the heater 42 to a temperature (e.g., 125° C.) exceeding the glass transition temperature (e.g., 124° C.) of the adhesive. The trouble, in such a case, is that the adhesive agent softens through glass transition and loses some of its bond strength. This means that separations can occur between the components making up the head and lower the durability of the head. In particular, a lowered adhesive strength between the diaphragm 34 and the cavity plate 31 or the piezoelectric element 36 reduces the rigidity of these components. The reduced component rigidity in turn hampers the displacement of the piezoelectric elements 36 from being precisely transmitted to the diaphragm 34, thus deteriorating the ink jetting performance and lowering print quality.

As mentioned, the cavity plate 31, nozzle plate 32, diaphragm 34, piezoelectric element 36 and base plate 50 are all composed of different materials. As such, the components have different thermal expansion coefficients. In particular, the cavity plate 31 has a thermal expansion coefficient of $25\times10^{-6}$, as opposed to $2\times10^{-6}$ for the diaphragm 34. There is a considerable difference between the cavity plate 31 and the diaphragm 34 in terms of thermal expansion coefficient.

As the head is heated by the heater 42, the difference in thermal expansion coefficient causes the diaphragm 34 and cavity plate 31 to develop a significant thermal stress therebetween, greater than between any other components. As a result, the diaphragm 34 and cavity plate 31 are especially liable to separate from each other.

The problem caused from such separation, when taking place, is that: it can degrade the vibration characteristic of the diaphragm 34, lower the ink jetting performance, worsen print quality available with the head, and deteriorate the durability of the head. The disadvantages resulting from the difference in thermal expansion coefficient between the different components of the head are far more serious than those experienced with glass transition of the adhesive agent or with thermally induced performance deterioration. An urgent need has been recognized to circumvent the above-described problems.

SUMMARY OF THE INVENTION

It is therefore an object of the present invention to overcome the aforementioned drawbacks and disadvantages of the prior art and to provide a highly durable ink jet head having its components bonded by adhesive agents accommodating the magnitudes of differences in thermal expansion coefficient between the head components, whereby high print quality is made available.

In carrying out the invention, and according to a first aspect thereof, there is provided an ink jet head comprising: a cavity plate incorporating a plurality of ink chambers to be filled with hot melt ink; an energizing element for generating jet energy causing the ink chambers to jet out the hot melt ink from inside; an energy transmitting means for transmitting the jet energy generated by the energizing element to the ink chambers; a nozzle plate having a plurality of nozzles through which to jet the hot melt ink out of the ink chambers; and a base plate with a manifold for supplying the hot melt ink into the ink chambers; wherein, of the above components of the ink jet head, those with a small difference in thermal expansion coefficient therebetween are bonded together by a first adhesive agent and those with a large difference in thermal expansion coefficient therebetween are bonded together by a second adhesive agent, the first adhesive agent developing glass transition at a temperature exceeding the temperature at which the ink jet head is operated, the second adhesive agent developing glass transition at a temperature below the temperature at which the ink jet head is operated.

In a first preferred structure according to the invention, the second adhesive agent is used to bond together a plurality of component types, one component type having a thermal expansion coefficient substantially at least three times that of any other component type to be bonded thereto.

In a second preferred structure according to the invention, the first adhesive agent has a glass transition temperature higher than the temperature at which the ink jet head is operated, and the second adhesive agent has a glass transition temperature lower by at least 40° C. than the temperature at which the ink jet head is operated.

In a third preferred structure according to the invention, the first and the second adhesive agents are each an epoxy adhesive agent.

According to a second aspect of the invention, there is provided an ink jet head made up of a plurality of components including: a vibrating plate; a piezoelectric element acting as an energizing element which is attached to a first surface of the vibrating plate and which comprises piezoelectric material and electrodes, the electrodes applying voltages to the piezoelectric material to generate a piezoelectric effect therein; a base plate furnished on the other surface of the piezoelectric element with one surface thereof attached to the vibrating plate; a cavity plate attached to a second surface on the other side of the first surface of the vibrating plate and including a plurality of ink chambers with nozzles, the cavity plate being changed in volume in accordance with the displacement of the vibrating plate so as to jet melted ink out of the ink chambers through the nozzles; a nozzle plate attached to the cavity plate and comprising the nozzles connected to the ink chambers; and heating means for keeping the ink melted inside the ink chambers; wherein a first adhesive agent is used to bond the piezoelectric element to the base plate, the cavity plate to the nozzle plate, and the vibrating plate to the piezoelectric element, and wherein a second adhesive agent is used to bond the vibrating plate to the cavity plate, the first adhesive agent developing glass transition at a temperature exceeding the temperature at which the ink jet head is operated, the second adhesive agent developing glass transition at a temperature below the temperature at which the ink jet head is operated.

In any one of the embodiments of the invention outlined above, those components of the ink jet head which have a small difference in thermal expansion coefficient therebetween are bonded together by the first adhesive agent developing glass transition at a temperature exceeding the temperature at which the ink jet head is operated. Those ink jet head components having a large difference in thermal expansion coefficient therebetween are bonded together by the second adhesive agent which develops glass transition at a temperature lower than the temperature at which the ink jet head is operated. In this makeup, while the ink jet head is active, the components secured by the first adhesive agent are prevented from a decline in the adhesive strength therebetween caused by the glass transition of that adhesive, preventing the deterioration in durability of the ink head or in ink jetting performance.

At the temperature at which the ink jet head is operated, the second adhesive agent develops glass transition, producing a softened adhesive layer between the components bonded together by that adhesive agent.

It follows that, with the ink jet head in operation, the softened adhesive agent can absorb a thermal stress caused by the difference in thermal expansion coefficient between the bonded head components. Acting in this manner, the softened adhesive agent prevents separation of the components. In other words, print quality available with the head is improved by minimizing the deterioration of the vibration characteristic of the vibrating plate. This in turn enhances the durability of the head and overall print quality of the printer incorporating the head.

In the above-mentioned second preferred structure of the invention, the first adhesive agent develops glass transition at a temperature higher than the temperature at which the head is operated, and the second adhesive agent has a glass transition temperature lower by at least 40° C. than the temperature at which the head is operated. Thus, if the temperature at which the head is active is illustratively 125° C., the first adhesive agent prevents the separation between the bonded components without developing glass transition, while the second adhesive agent develops glass transition to absorb the thermal stress difference between the glued components, as will be described later with reference to a specific embodiment of the invention.

In the above third preferred structure of the invention, the fact that the first and the second adhesive agents are each an epoxy adhesive agent means little chemical reaction taking place between the ink and the adhesive agents. Unlike some conventional heads using silicone adhesive agents, the inventive head with its components bonded by epoxy adhesives is free of the danger of the adhesive silicone dissolving into the ink and lowering print quality.

In the structure according to the aforementioned second aspect of the invention, the first adhesive agent is used to bond the piezoelectric element to the base plate, the cavity plate to the nozzle plate, and the vibrating plate to the piezoelectric element. Thus, at the temperature at which the head is active, the structure of the invention prevents deterioration of the first adhesive agent and thereby staves off separation between the components bonded together by that adhesive. With the vibrating plate and the cavity plate bonded together by the second adhesive agent, the adhesive layer between these components softens at the temperature at which the head is operated, thereby absorbing the thermal stress difference between the bonded components and preventing their separation.

These and other objects, features and advantages of the invention will become more apparent upon a reading of the following description and appended drawings.

BRIEF DESCRIPTION OF THE DRAWINGS

A preferred embodiment of the present invention will now be described in detail with reference to the following figures wherein:

FIG. 5 is a table listing the results of peel tests conducted on various head components.

DESCRIPTION OF PREFERRED EMBODIMENTS

A preferred embodiment of the invention will now be described with reference to the accompanying drawings. What follows is a description of an ink jet head embodying the invention representatively and used by a hot melt type color ink jet printer (abbreviated where appropriate to "the printer" hereunder) which performs color printing by jetting ink of a plurality of colors.

Figure 1:
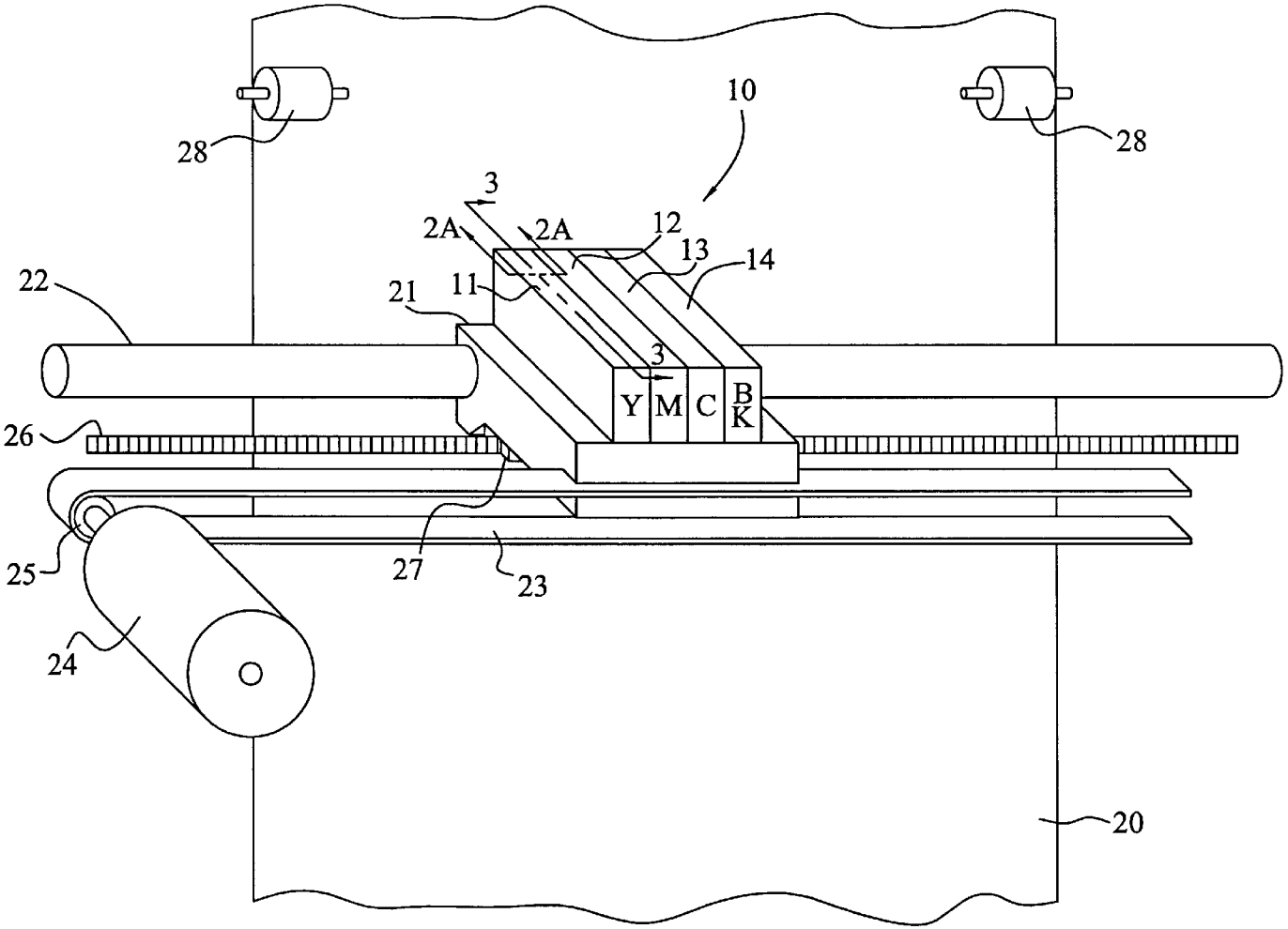
FIG. 1 is a perspective view of some mechanisms in a printer comprising one preferred embodiment of the invention.

The printer will be first described mechanically by referring to FIG. 1. FIG. 1 is a perspective view of some mechanisms in the printer comprising the head.

As shown in FIG. 1, the printer includes a print head 10 made up of four subordinate heads: a yellow ink head 11 for ejecting yellow ink, a magenta ink head 12 for ejecting magenta ink, a cyan ink head 13 for ejecting cyan ink, and a black ink head 14 for ejecting black ink. Each of the heads 11 trough 14 is equipped with an ink tank housing solid ink.

The print head 10 is mounted on a carriage 21 penetrated by a guide shaft 22 positioned in the crosswise direction of print paper 20. The carriage 21 is attached to an endless belt 23 located underneath and along the guide shaft 22. The endless belt 23 is engaged with a pulley 25 on the shaft of a motor 24. In this setup, the revolutions of the motor 24 cause the carriage 21 to reciprocate along the guide shaft 22 in the crosswise direction of the print paper 20.

A timing slit member 26 with a plurality of slits engraved thereon is furnished underneath and parallel to the guide shaft 22. In front of and below the carriage 21 is an encoder element 27 for reading the number of slits from the timing slit member 26. The print paper 20 is fed vertically, pinched between paper feed rollers rotated by a paper feed motor and holding rollers 28 placed opposite to the paper feed rollers.

The structure of the heads 11 through 14 will now be described with reference to FIGS. 2A through 4. Since the four heads are structurally identical, the head 11 alone will be described representatively.

Figure 2A:
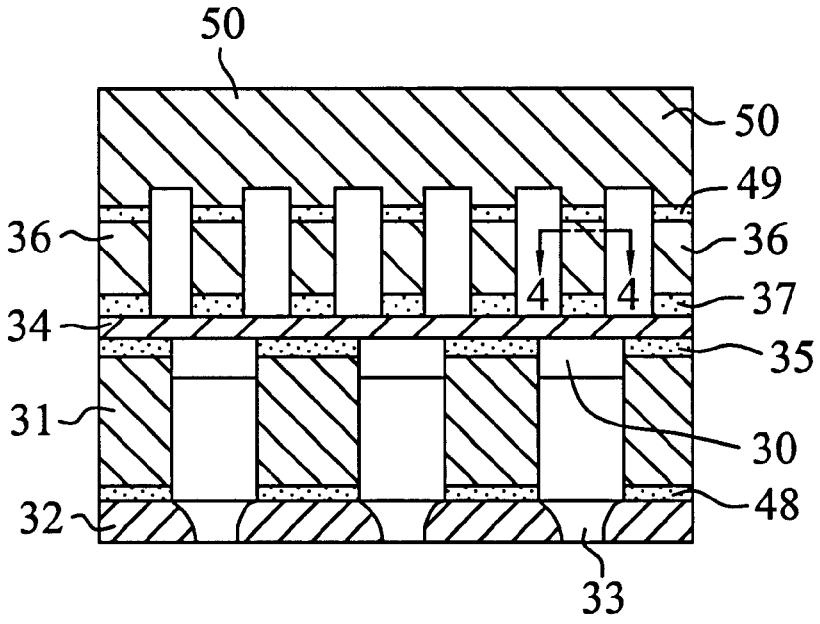
FIG. 2A is a partially sectional view of the head.
Figure 2B:
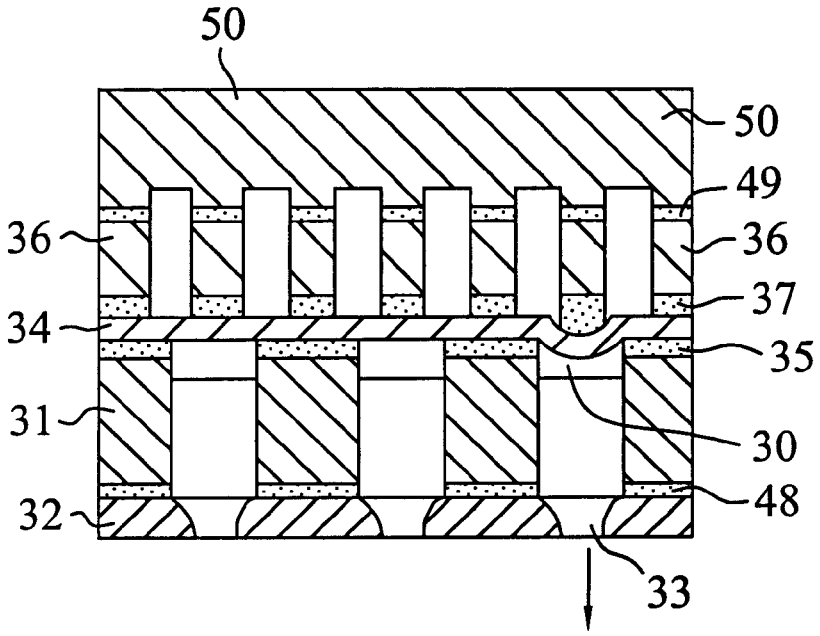
FIG. 2B is another partially sectional view of the head.
Figure 3:
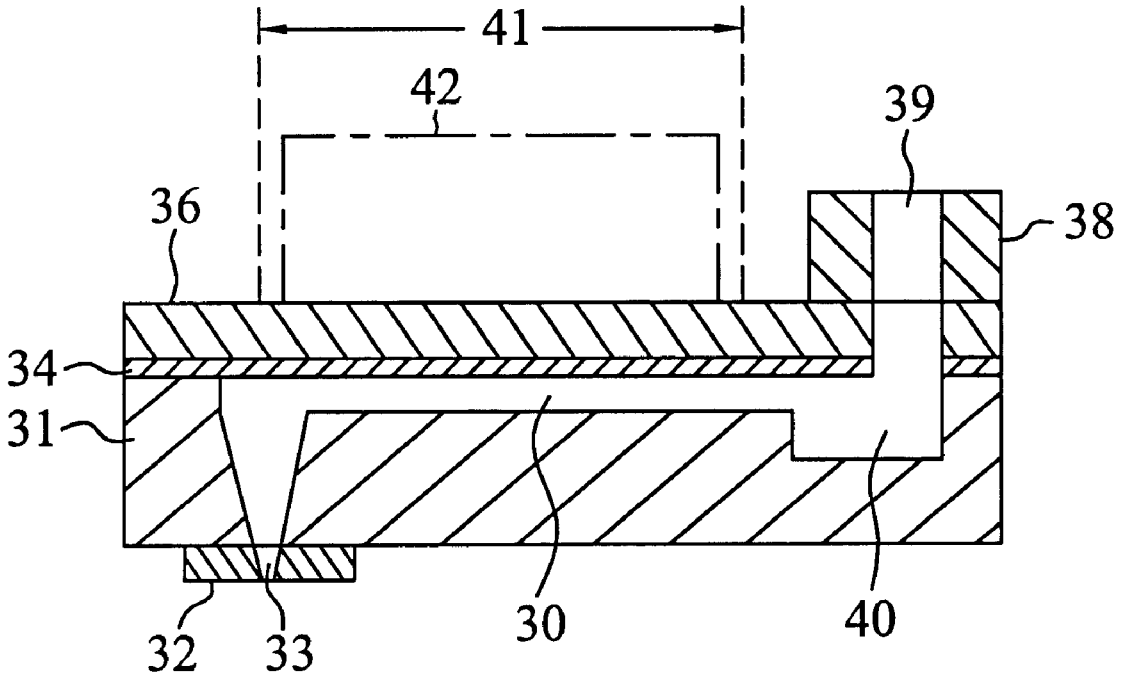
FIG. 3 is a longitudinal sectional view of the head.

FIGS. 2A and 2B are partially sectional views of the head 11. In the figures, the lower plane of the head 11 faces the printer paper 20 (see FIG. 1). FIG. 3 is a longitudinal sectional view of the head 11 of FIG. 2A as viewed laterally, with the base plate omitted.

As depicted in FIG. 2A, the head 11 has a plurality of ink chambers (cavities) 30 for housing ink. The ink chambers 30 are separated from one another by walls of the cavity plate 31. An adhesive layer 48 attaches a nozzle plate 32 to the underside of the ink chambers 30 and cavity plate 31. The nozzle plate 32 has a plurality of nozzles 33 formed penetratingly therethrough. The nozzles 33 allow ink to be jetted out of the ink chambers 30. An adhesive layer 35 attaches a diaphragm (vibrating plate) 34 to the top of the ink chambers 30 and cavity plate 31.

In this embodiment, as shown in FIG. 2A, each ink chamber 30 measures 0.22 mm wide and 0.15 mm high, and each cavity plate 31 formed by PES measures 0.119 mm wide and 2.5 mm thick. The nozzle plate 32 is made of nickel. Each nozzle 33 at its lowest part measures 55 $\mu$m in diameter. The diaphragm 34 is formed by an aramid film, is 9 $\mu$m thick, and has a thermal expansion coefficient of $2\times10^{-6}$. The cavity plate 31 has a thermal expansion coefficient of $25\times10^{-6}$, compared with $14\times10^{-6}$ of the nozzle plate 32.

Past experiments involving materials of varied thermal expansion coefficients have shown that if the thermal expansion coefficient of one member is approximately at least three times that of any other member bonded thereto, a thermal stress is known to develop therebetween, causing the bonded members to separate.

As shown in FIG. 2A, an adhesive layer 37 attaches a plurality of piezoelectric elements 36 acting as plate-like energizing elements to the top of the diaphragm 34. Another adhesive layer 49 bonds a base plate 50 supporting the piezoelectric elements 36 to their top. A manifold plate 38 to form ink injection holes 39 is furnished behind the base plate 50, as illustrated in FIG. 3. The underside of the ink injection holes 39 has a manifold 40 penetrating the ink chambers 30. The top of each piezoelectric element 36 is provided with a heater 42 as heating means to keep the ink melted inside the ink chamber 30. In FIG. 3, the portion approximately corresponding to the ink chamber 30 constitutes an active part 41, i.e, a part in which the piezoelectric element 36 produces displacement through the piezoelectric effect.

With this embodiment, as shown in FIG. 2A, each piezoelectric element 36 is made of a piezoelectric material such as PZT (lead-zirconium-titanate) and measures 0.08 mm wide and 0.5 mm thick. The center-to-center pitch of the cavity plate 31 is 0.339 mm, and each ink injection hole 39 measures 2.0 mm in diameter. The manifold 40 is 1.5 mm deep and 2.0 mm wide, while the active part 41 measures 4.0 mm in width. The piezoelectric elements 36 have a thermal expansion coefficient of $2\times10^{-6}$ as opposed to $5\times10^{-6}$ of the base plate 50.

The adhesive layers 37, 48 and 49 are each formed by an epoxy adhesive agent having a glass transition temperature Tg of 127° C., higher than the temperature of the head in active use (e.g., 125° C.). That is, the diaphragm 34 and piezoelectric elements 36 have the same thermal expansion coefficient. There is less than a threefold difference in thermal expansion coefficient between the cavity plate 31 and the nozzle plate 32, as well as between the piezoelectric element 36 and the base plate 50.

Because there is little difference in thermal stress between the diaphragm 34 and the piezoelectric elements 36, their separation will not be caused by the thermal stress difference. However, a separation of these components can still result from deterioration of the adhesive agent attributable to its glass transition. Such a separation is forestalled by an adhesive agent having a glass transition temperature (e.g., 127° C.) higher than the head operating temperature (e.g., 125° C.), used between the diaphragm 34 and the piezoelectric elements 36.

Meanwhile, the adhesive agent forming the adhesive layer 35 between the diaphragm 34 and the cavity plate 31 is an epoxy adhesive agent illustratively having a glass transition temperature Tg of, for example, 79° C., lower by at least 40° C. than the temperature (125° C.) of the head in active use. There occurs more than a threefold difference in thermal expansion coefficient between the cavity plate 31 and the diaphragm 34, hence a large thermal stress is generated therebetween. In this case, the adhesive layer 35 with its glass transition temperature Tg lower by at least 40° C. than the typical head temperature of 125° C. softens by developing glass transition at that head temperature. The softened adhesive layer 35 absorbs the thermal stress generated between the cavity plate 31 and the diaphragm 34, thereby preventing their separation.

According to the inventor's experiments, each adhesive layer is preferably formed so as to have a thickness of 3 to 25 μm, in view of both maintaining high adhesive strength between the bonded components and absorbing the thermal stress therebetween. More preferably, the adhesive layer should measure 5 to 20 μm thick, or more preferably 5 to 10 μm thick. The best results are obtained when the adhesive layer measures 5 μm in thickness. Furthermore, the use of epoxy adhesives is preferred because they are unlikely to react chemically with the ink. Unlike silicone adhesive agents, epoxy adhesives do not dissolve into the ink through chemical reaction and therefore do not blur the contours of printed portions on plastic resin sheets and the like.

Figure 4:
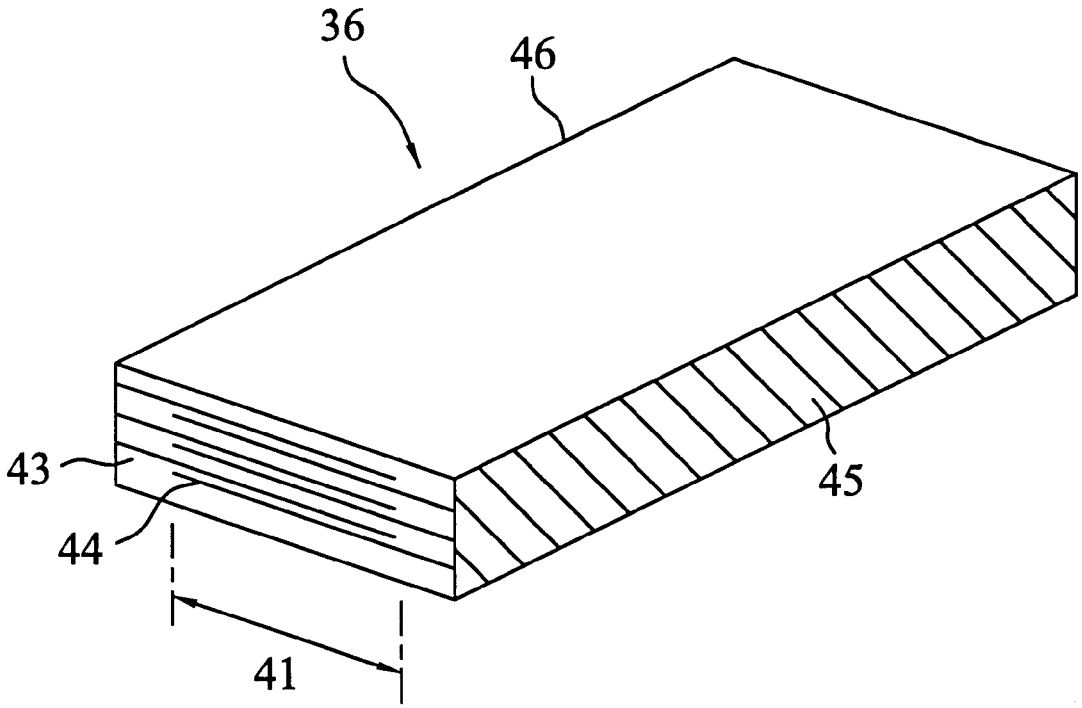
FIG. 4 is a partially sectional view showing a typical structure of a piezoelectric element.
Figure 1:
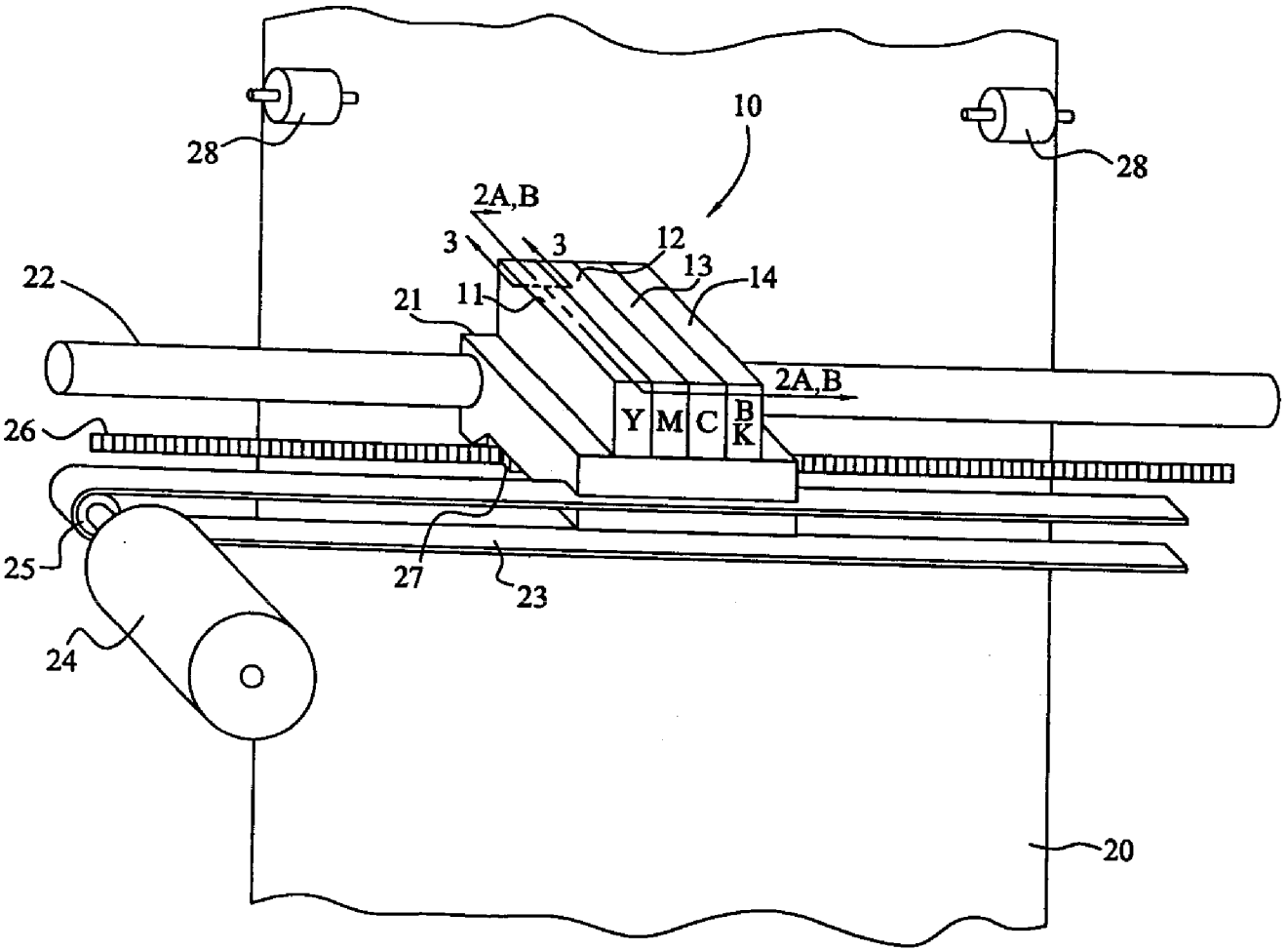

The structure of the piezoelectric element 36 will now be described with reference to FIG. 4. FIG. 4 is a partially sectional view showing a typical structure of the piezoelectric element 36.

As shown in FIG. 4, the piezoelectric element 36 is formed by alternately stacking piezoelectric films 43 made of piezoelectric material and electrode films (internal electrode) 44. In this makeup, the piezoelectric films 43 are polarized in the stacking direction. Although not shown in FIG. 4, between 10 to 20 layers constitute the piezoelectric element 36 in practice. Both ends of the piezoelectric element 36 are furnished with edge electrodes 45 and 46.

In this embodiment, each piezoelectric film 43 measures approximately 30 μm in thickness. The electrode films 44 and edge electrodes 45 and 46 are each formed by silver palladium (70% silver, 30% palladium) to have a thickness of 2 to 3 μm.

The ink used by the embodiment contains paraffin wax as its major ingredient. Any one of three kinds of ink (A, B, C), for example, is used: ink A with a softening point of 56° C. to 58° C. and a melting point of 69° C. to 71° C.; ink B with a softening point of 62° C. to 64° C. and a melting point of 76° C. to 78° C.; and ink C with a softening point of 81° C. to 86° C. and a melting point of 92° C. to 94° C. The appropriate kind of ink is selected illustratively by taking into account the viscosity at the temperature of the printer in operation (e.g., 2 to 50 cPs), surface tension, chromaticity after printing, and post-printing saturation.

In operation, a head driving circuit applies a voltage to each electrode film 44 producing the piezoelectric effect in each piezoelectric film 43. This bends the diaphragm 34 into a downward convex shape as shown in FIG. 2B, applying pressure to the ink chamber 30 and causing the ink to jet out through the nozzle 33. The heads 11 through 14 may each be operated singly to perform monochromatic printing, or may be selectively activated in combination to jet out simultaneously a plurality of colors of ink to carry out medium tone printing.

Described below with reference to FIG. 5 are the results of peel tests conducted on the components constituting the head 11.

The peel tests were carried out on two categories of components: components with a large difference in thermal expansion coefficient therebetween, composed of PES (having a thermal expansion coefficient of $25\times10^{-6}$) and alumina (coefficient: $5\times10^{-6}$); and components with a small difference in thermal expansion coefficient therebetween, formed by piezoelectric material PZT ($2\times10^{-6}$) and alumina ($5\times10^{-6}$).

For the peel tests, a 5 mm×40 mm alumina board was bonded to the middle of a 20 mm×20 mm PES board. Four wires were attached to the four corners of the PES board, and the wires were pulled by a tension spring balance at a tensile load of 70 g for the tests. The peel tests were also carried out on another setup involving a PZT board glued to an alumina board.

Three kinds of adhesive agents were used: an adhesive with a glass transition temperature Tg higher than 125° C. (high Tg type), an adhesive with a glass transition temperature Tg between 85° C. and 125° C. (medium Tg type), and an adhesive with a glass transition temperature Tg lower than 85° C. (low Tg type). Each adhesive agent was stamped to a thickness of 20 μm. Two ambient situations were prepared into which the components under test were exposed. In one situation, the temperature of 125° C. was kept for 132.5 hours. The other situation was one in which a thermal cycle of heating up to 125° C. followed by natural cooling to the room temperature of 25° C. was repeated dozens of times at intervals of several minutes.

In the table of FIG. 5, a double circle (◎) means total absence of separation, a single circle (○) denotes the presence of few separations, a triangle (Δ) indicates that overall quality was satisfactory despite some separations, and a cross (×) points to the occurrence of numerous separations.

As is evident in FIG. 5, the best results were acquired in the two ambient situations when the high Tg type adhesive agent was used to bond together the components with the small difference in thermal expansion coefficient therebetween, and the low Tg type adhesive agent was employed to glue the components having the large difference in thermal expansion coefficient therebetween.

It is also clear from FIG. 5 that the high Tg type adhesive agent having a glass transition temperature higher than the head temperature is most desirable for bonding together the components with the small difference in thermal expansion coefficient therebetween. However, the durability of the head and the ink jetting performance were fairly satisfactory even where the medium Tg type adhesive agent (with a glass transition temperature a little lower than the head temperature) or the low Tg type adhesive agent (with a glass transition temperature definitively lower than the head temperature) was used to bond together the components with the small difference in thermal expansion coefficient therebetween.

As described, the embodiment utilizes the high Tg type adhesive agent to bond together the components with the small difference in thermal expansion coefficient therebetween, and the low Tg type adhesive agent to glue the components having the large difference in thermal expansion coefficient therebetween. This prevents separations between the head components while enhancing the head durability and improving the ink jetting performance at the same time.

Of the piezoelectric element 36, diaphragm 34 and cavity plate 31 significantly affecting the ink jetting performance, the diaphragm 34 and cavity plate 31 with a considerable difference in thermal expansion coefficient therebetween are preferably glued together using an adhesive agent capable of absorbing the thermal stress generated between the bonded components. This also contributes to improving the durability of the head and boosting the ink jetting performance at the same time. The head components not seriously affecting the ink jetting performance or those with only a limited difference in thermal expansion coefficient therebetween may be preferably bonded together by use of an adhesive agent having a high glass transition temperature.

The head having the above-described features may be applied illustratively to the printer. When equipped with the inventive head, the printer provides high quality printing.

As many apparently different embodiments of this invention may be made without departing from the spirit and scope thereof, it is to be understood that the invention is not limited to the specific embodiments thereof except as defined in the appended claims.

What is claimed is:

1. A hot melt ink ink jet head comprising:

a cavity plate incorporating a plurality of ink chambers to be filled with hot melt ink;

an energizing element for generating energy for jetting the hot melt ink from said ink chambers;

an energy transmitting element for transmitting the energy generated by said energizing element to said ink chambers;

a nozzle plate having a plurality of nozzles through which said hot melt ink is jetted from said ink chambers; and a base plate with a manifold for supplying said hot melt ink into said ink chambers;

wherein said energizing element and said base plate, said cavity plate and said nozzle plate, and said energy transmitting element and said energizing element respectively, have a small difference in thermal expansion coefficient therebetween and are bonded together by a first adhesive agent, said first adhesive agent developing glass transition at a temperature exceeding an operating temperature of said ink jet head, said energy transmitting element and said cavity plate have a large difference in thermal expansion coefficient therebetween and are bonded together by a second adhesive agent, and said second adhesive agent developing glass transition at a temperature below said operating temperature and thereby softens at said operating temperature.

2. The ink jet head according to claim 1, wherein said second adhesive agent is used to bond together a plurality of components of said ink jet head, one component having a thermal expansion coefficient substantially at least three times that of a second component to be bonded thereto.

3. The ink jet head according to claim 1, wherein said second adhesive agent has a glass transition temperature lower by at least 40° C. than said operating temperature.

4. The ink jet head according to claim 1, wherein said first and said second adhesive agents are an epoxy adhesive agent.

5. The ink jet head according to claim 1, further comprising a heater for melting said hot melt ink.

6. The ink jet head according to claim 1, wherein an adhesive layer formed by said second adhesive agent is 3 to 25 $\mu$m thick.

7. A hot melt ink ink jet head made up of a plurality of components including:

a vibrating plate;

a piezoelectric element which is attached by a first adhesive agent to a first surface of said vibrating plate and which comprises piezoelectric material and electrodes, said electrodes applying voltages to said piezoelectric material to generate a piezoelectric effect therein;

a base plate furnished on a first surface of said piezoelectric element with a second surface of said piezoelectric element attached to said vibrating plate;

a cavity plate attached to a second surface of said vibrating plate and including a plurality of ink chambers, said cavity plate being changed in volume in accordance with a displacement of said vibrating plate so as to jet hot melt ink out of said ink chambers;

a nozzle plate attached to said cavity plate and comprising nozzles connected to said ink chambers; and a heater for keeping the ink melted inside said ink chambers;

wherein said vibrating plate and said cavity plate have a large difference in thermal expansion coefficient therebetween and are bonded together by a second adhesive agent, said second adhesive agent developing glass transition at a temperature below an operating temperature of said ink jet head and softening at said operating temperature.

8. The ink jet head according to claim 7, wherein components of said ink jet head with a small difference in thermal expansion coefficient therebetween are bonded together by said first adhesive agent, said first adhesive agent developing glass transition at a temperature exceeding said operating temperature.

9. The ink jet head according to claim 8, wherein said first adhesive agent is used to bond said piezoelectric element to said base plate, said cavity plate to said nozzle plate, and said vibrating plate to said piezoelectric element, and wherein said second adhesive agent is used to bond said vibrating plate to said cavity plate.

10. The ink jet head according to claim 7, wherein said glass transition temperature of said second adhesive agent is lower by at least 40° C. than said temperature at which said ink jet head is operated.

11. The ink jet head according to claim 7, wherein said second adhesive agent is used to bond together a plurality of components, one component having a thermal expansion coefficient substantially at least three times that of any other component to be bonded thereto.

12. The ink jet head according to claim 7, wherein each of said first adhesive agent and said second adhesive agent are epoxy adhesive agents.

13. A hot melt ink ink jet head comprising:

a cavity plate incorporating a plurality of ink chambers to be filled with hot melt ink;

an energizing element for generating energy causing said ink chambers to jet out said hot melt ink from inside;

an energy transmitting element for transmitting the energy generated by said energizing element to said ink chambers;

a nozzle plate having a plurality of nozzles through which to jet said hot melt ink out of said ink chambers; and a base plate with a manifold for supplying said hot melt ink into said ink chambers;

wherein said energy transmitting element and said cavity plate have a large difference in thermal expansion coefficient therebetween and are bonded together by a second adhesive agent which develops glass transition at a temperature below an operating temperature of said ink jet head and thereby softens at said operating temperature, wherein a first adhesive agent bonds said energizing element to said base plate, said cavity plate to said nozzle plate, and said energy transmitting element to said energizing element.

14. The ink jet head according to claim 13, further comprising a heater for melting said hot melt ink.

15. The ink jet head according to claim 13, wherein the adhesive layer formed by said second adhesive agent is 3 to 25 $\mu$m thick.

16. The ink jet head according to claim 13, wherein said glass transition temperature of said second adhesive agent is lower by at least 40° C. than said temperature at which said ink jet head is operated.

17. The ink jet head according to claim 13, wherein said first and second adhesive agents are an epoxy adhesive agent.

* * * * *

UNITED STATES PATENT AND TRADEMARK OFFICE

CERTIFICATE OF CORRECTION

PATENT NO. : 6,003,968
DATED : December 21, 1999
INVENTOR(S) : Hirokazu Kozawa

It is certified that error appears in the above-identified patent and that said Letters Patent is hereby corrected as shown below:

Drawings,
Delete Figure 1 and substitute Figure 1 attached hereto.

Column 4,
Line 67, after "partially" add the word -- longitudinal --.

Column 5,
Line 1, after "partially" add the word -- longitudinal --.
Line 2, the word "longitudinal" should be -- transverse --.
Line 47, after "partially" add the word -- longitudinal --.
Line 49, the word "longitudinal" should be -- transverse --.

Signed and Sealed this

Twenty-eighth Day of June, 2005

JON W. DUDAS
*Director of the United States Patent and Trademark Office*